US007854570B2

(12) United States Patent
Heidari

(10) Patent No.: US 7,854,570 B2
(45) Date of Patent: Dec. 21, 2010

(54) PONTOONLESS TENSION LEG PLATFORM

(75) Inventor: Amir Homayoun Heidari, Houston, TX (US)

(73) Assignee: Seahorse Equipment Corporation, Houston, TX (US)

( * ) Notice: Subject to any disclaimer, the term of this patent is extended or adjusted under 35 U.S.C. 154(b) by 0 days.

(21) Appl. No.: 12/117,584

(22) Filed: May 8, 2008

(65) Prior Publication Data

US 2009/0279958 A1 Nov. 12, 2009

(51) Int. Cl.
*B63B 35/44* (2006.01)

(52) U.S. Cl. ..... 405/223.1; 405/224; 405/224.2; 114/264; 114/265

(58) Field of Classification Search ..... 405/223.1, 405/224, 224.2; 114/264–266
See application file for complete search history.

(56) References Cited

U.S. PATENT DOCUMENTS 3,612,177 A * 10/1971 Gassett et al. ..... 114/265
3,762,352 A 10/1973 Brahtz
3,837,309 A 9/1974 Biewer
3,885,511 A * 5/1975 Wipkink et al. ..... 114/265
3,905,319 A 9/1975 Schuh
3,919,957 A * 11/1975 Ray et al. ..... 405/224
3,952,684 A * 4/1976 Ferguson et al. ..... 114/265
3,976,021 A * 8/1976 Blenkarn et al. ..... 405/223.1
3,982,401 A 9/1976 Loggins
3,983,706 A * 10/1976 Kalinowski ..... 405/223.1
4,062,313 A * 12/1977 Stram ..... 405/223.1
4,169,424 A 10/1979 Newby et al.
4,274,356 A * 6/1981 Finsterwalder ..... 114/265
4,395,160 A * 7/1983 deJong ..... 405/223.1
4,451,170 A * 5/1984 Cowan ..... 114/265
4,585,373 A 4/1986 Collipp
4,626,137 A 12/1986 Willemsz
4,723,875 A 2/1988 Sutton
4,784,529 A * 11/1988 Hunter ..... 405/223.1

(Continued)

FOREIGN PATENT DOCUMENTS

GB 1098211 1/1968

(Continued)

*Primary Examiner*—Frederick L Lagman
(74) *Attorney, Agent, or Firm*—Wong, Cabello, Lutsch, Rutherford, Brucculeri, L.L.P.

(57) ABSTRACT

A pontoonless tension leg platform (TLP) has a plurality of buoyant columns connected by an above-water deck support structure. The design eliminates the need for subsea pontoons extending between the surface-piercing columns. In certain embodiments, the buoyancy of the columns is increased by the addition of subsea sections of increased diameter (and/or cross-sectional area) to provide the buoyancy furnished by the pontoons of the TLPs of the prior art. A pontoonless TLP has a smaller subsea projected area in both the horizontal and vertical planes than a conventional multi-column TLP of equivalent load-bearing capacity having pontoons between the columns. This reduction in surface area produces a corresponding reduction in the platform's response to ocean currents and wave action and consequently allows the use of smaller and/or less costly mooring systems. Moreover, the smaller vertical projected area results in a shorter natural period which enables a pontoonless TLP according to the invention to be used in water depths where conventional TLPs cannot be used due to their longer natural periods. The absence of pontoons in a multi-column TLP also has the added benefit of providing an unobstructed path for risers to connect with the deck of the platform.

18 Claims, 2 Drawing Sheets

U.S. PATENT DOCUMENTS

| | | | | | |
|---|---|---|---|---|---|
| 4,793,738 | A | * | 12/1988 | White et al. | 405/223.1 |
| 4,829,928 | A | | 5/1989 | Bergman | |
| 4,850,744 | A | | 7/1989 | Petty et al. | |
| 4,864,958 | A | | 9/1989 | Belinsky | |
| 4,906,139 | A | | 3/1990 | Chiu et al. | |
| 5,012,756 | A | | 5/1991 | Kristensen | |
| 5,363,788 | A | | 11/1994 | Delrieu | |
| 5,555,838 | A | * | 9/1996 | Bergman | 114/265 |
| 5,558,467 | A | | 9/1996 | Horton | |
| 5,575,592 | A | * | 11/1996 | Pollack | 405/223.1 |
| 5,707,178 | A | | 1/1998 | Srinivasan | |
| 6,024,040 | A | | 2/2000 | Thomas | |
| 6,347,912 | B1 | | 2/2002 | Thomas | |
| 6,431,167 | B1 | | 8/2002 | Gonda et al. | |
| 6,478,511 | B1 | | 11/2002 | Hudson et al. | |
| 6,652,192 | B1 | | 11/2003 | Xu et al. | |
| 6,718,901 | B1 | | 4/2004 | Abbott et al. | |
| 6,935,810 | B2 | * | 8/2005 | Horton, III | 405/224 |
| 2002/0178989 | A1 | * | 12/2002 | Nelson | 114/265 |
| 2005/0084336 | A1 | | 4/2005 | Xu et al. | |
| 2005/0120935 | A1 | * | 6/2005 | Wybro et al. | 114/265 |

FOREIGN PATENT DOCUMENTS

| | | |
|---|---|---|
| GB | 1310142 | 3/1973 |
| GB | 1354549 | 5/1974 |
| GB | 1462401 | 1/1977 |

* cited by examiner

FIG. 3
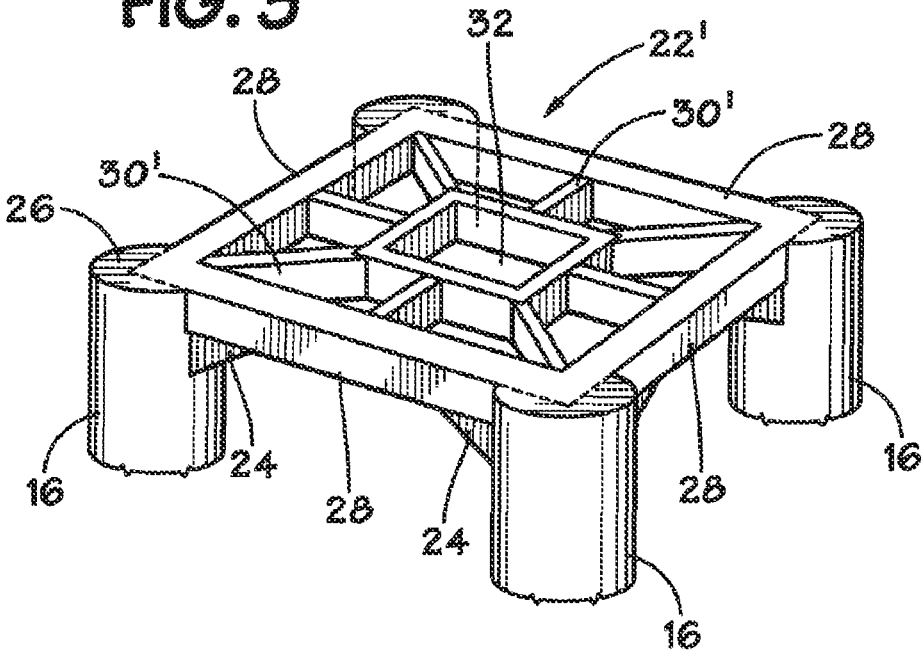
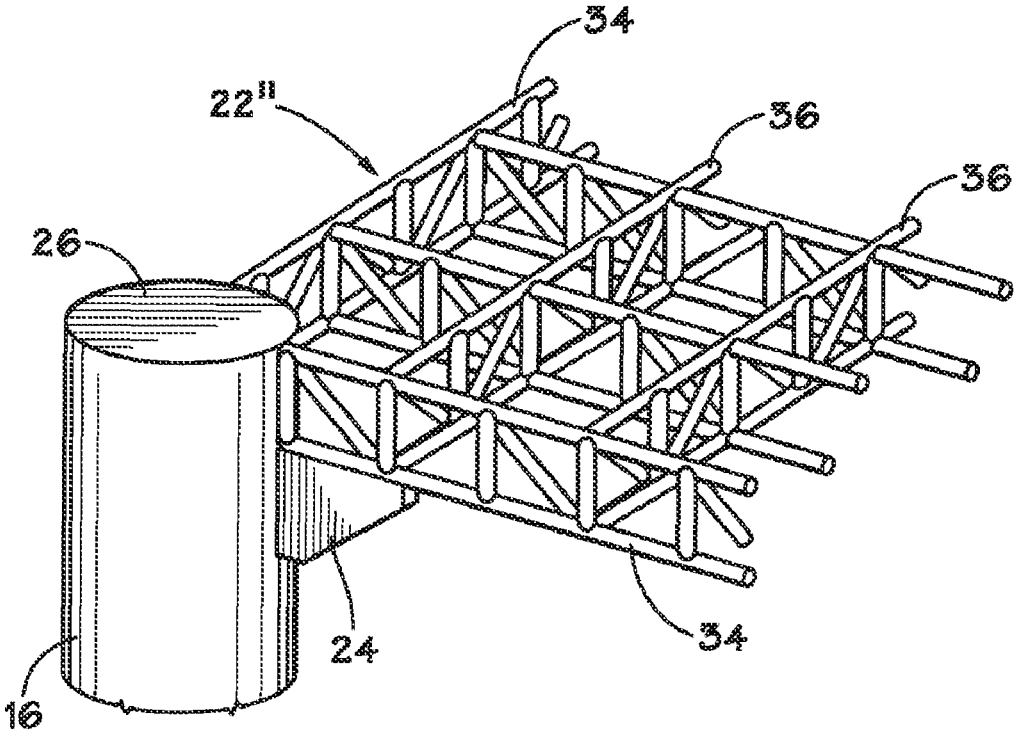
FIG. 4

PONTOONLESS TENSION LEG PLATFORM

CROSS-REFERENCE TO RELATED APPLICATIONS

None

STATEMENT REGARDING FEDERALLY SPONSORED RESEARCH OR DEVELOPMENT

Not Applicable

BACKGROUND OF THE INVENTION

1. Field of the Invention

This invention relates to offshore platforms. More particularly, it relates to tension leg platforms (TLPs).

2. Description of the Related Art Including Information Disclosed Under 37 CFR 1.97 and 1.98.

A tension leg platform (TLP) is a vertically moored floating structure typically used for the offshore production of oil and/or gas, and is particularly suited for water depths greater than about 1000 ft.

The platform is permanently moored by tethers or tendons grouped at each of the structure's corners. A group of tethers is called a tension leg. The tethers have relatively high axial stiffness (low elasticity) such that virtually all vertical motion of the platform is eliminated. This allows the platform to have the production wellheads on deck (connected directly to the subsea wells by rigid risers), instead of on the seafloor. This feature enables less expensive well completions and allows better control over the production from the oil or gas reservoir.

A variety of TLP designs are known in the art. The following patents describe various examples.

U.S. Pat. No. 4,585,373 describes a tension leg platform with exterior buoyant columns located outside the normal tension leg platform structure. The exterior columns are designed to decrease the pitch period of the tension leg platform away from the point of concentration of the largest wave spectrum energy encountered at a particular marine location. This modification of the pitch period of the tension leg platform is said to reduce the cyclic fatigue stresses in the tension legs of the platform thereby increasing the useful life of the platform structure.

U.S. Pat. No. 6,024,040 describes an off-shore oil production platform that includes an upper barge above the level of the sea. The barge is connected to a completely submerged hollow lower base by partially submerged vertical connecting legs forming a buoyancy tank. The legs along their submerged height include at least two successive portions. A first portion with solid walls delimits a closed space and forms a buoyancy tank. A second portion with openwork sidewall has an interior space that is open to the surrounding marine environment.

U.S. Pat. No. 6,652,192 describes a heave-suppressed, floating offshore drilling and production platform with vertical columns, lateral trusses connecting adjacent columns, a deep-submerged horizontal plate supported from the bottom of the columns by vertical truss legs, and a topside deck supported by the columns. The lateral trusses connect adjacent columns near their lower end to enhance the structural integrity of the platform. During the launch of the platform and towing in relatively shallow water, the truss legs are stowed in shafts within each column, and the plate is carried just below the lower ends of the columns. After the platform has been floated to the deep water drilling and production site, the truss legs are lowered from the column shafts to lower the plate to a deep draft for reducing the effect of wave forces and to provide heave and vertical motion resistance to the platform. Water in the column shafts is then removed, lifting the platform so that the deck is at the desired elevation above the water surface.

U.S. Pat. No. 3,982,401 describes a semisubmersible marine structure for operation in offshore waters that comprises a work deck which is supported by a buoyant substructure. The substructure includes a separable anchor unit which can be lowered to the floor of the offshore site and thereafter weighted in order to regulate the position of the floating structure. Tensioning lines extending between the anchor and the structure draw the latter downward below its normal floating disposition. Outboard anchor lines are used to locate the structure laterally with respect to its position over a drill site.

U.S. Pat. No. 6,347,912 describes an installation for producing oil from an off-shore deposit that includes a semi-submersible platform, at least one riser connecting the platform to the sea bed, and devices for tensioning the riser. The tensioning devices for each riser include at least one submerged float connected to a point on the main run of the riser for hauling it towards the surface, and a mechanism for hauling the riser. The mechanism is installed on the platform and applied to the top end of the riser.

U.S. Pat. No. 5,558,467 describes a deep water offshore apparatus for use in oil drilling and production in which an upper buoyant hull of prismatic shape has a passage that extends longitudinally through the hull. Risers run through the passage and down to the sea floor. A frame structure connected to the hull bottom and extending downwardly comprises a plurality of vertically arranged bays defined by vertically spaced horizontal water entrapment plates providing open windows around the periphery of the frame structure. The windows provide transparency to ocean currents and to wave motion in a horizontal direction to reduce drag. The frame structure serves to modify the natural period and stability of the apparatus to minimize heave, pitch, and roll motions of the apparatus. A keel assembly at the bottom of the frame structure has ballast chambers for enabling the apparatus to float horizontally and for stabilization of the apparatus against tilting in the vertical position.

U.S. Pat. No. 4,850,744 describes a semi-submersible, deep-drafted platform which includes a fully submersible lower hull, and a plurality of stabilizing columns which extend from the lower hull to an upper hull. At least one column has means adapted to reduce the water plane area within a portion of the dynamic wave zone of the column and to increase the natural heave period of the platform.

U.S. Pat. No. 4,723,875 describes a deep-water support assembly for a jack-up type marine structure that comprises a support base, pile guides in the base through which piles are driven to anchor the support base to a marine floor, a receptacle containing a grouting material and adapted to mate with the jack-up structure for providing an anchoring foundation, and a support structure for supporting the receptacle at a fixed height below the marine surface. In one version, a tension leg support assembly is provided in place of the tower assembly. The tension leg assembly also comprises a support base structure, means for anchoring the support base structure to the marine floor, and receptacle means containing a grouting material and adapted to mate with the jack-up structure for providing an anchoring foundation. However, the receptacle means is provided with ballasting and de-ballasting chambers which permit the receptacle means to be employed as a tension leg platform which can be supported from the base structure by tension cables acting in opposition to the buoyancy forces created by de-ballasting the platform once the cables have been secured to the ballasted receptacle means during assembly.

U.S. Pat. No. 3,837,309 describes a floating offshore device that includes a water tight hull, which is adapted to be ballasted to a submerged stage and, when submerged, retained in position by buoying means that can sway relative to the hull. Structural columns fastened to the vessel extend above the water and support a floatable platform above the water when the device is in operable working position. The platform rests on the vessel when the device is being moved.

U.S. Pat. No. 4,169,424 describes a tension leg buoyancy structure for use in seas exposed to wave action that includes a buoyancy section, an anchor section which rests on the sea bed, and a plurality of parallel tethers connecting the buoyancy section with the anchor section to permit the buoyancy section to move relative to the anchor section. Design parameters are selected such that the natural period of the buoyancy section for linear oscillation in the direction of wave travel, the natural period of the buoyancy section for linear oscillation in a horizontal direction perpendicular to the direction of wave travel, and the natural period of the buoyancy section for rotational oscillation about a vertical axis of the buoyancy section structure are greater than 50 seconds.

U.S. Pat. No. 4,906,139 describes an offshore well test platform system that comprises a submerged buoy restrained below the surface of the water by a plurality of laterally extending, tensioned cables, a platform structure connected to a submerged buoy with an upper portion that extends above the surface of the water, and a flexible riser that connects the well to a well test platform deck above the surface of the water.

U.S. Pat. No. 5,012,756 describes a floating structure with completely or partially submersible pontoons that provide the buoyancy for an offshore drilling platform, with a deck that is located on columns attached to the pontoons. A separate, submerged ballast unit is attached to the pontoons to help stabilize the floating structure and improve its motion in waves. The ballast unit is approximately the same size in the horizontal plane as the extent of the pontoons and is attached to the floating structure at each corner by at least three vertical struts that extend through and below the pontoons. The struts are attached so that they can be connected or removed from a locking device on the top side of the pontoons. At the upper end of the struts, an attachment head is provided which can be connected and removed from a lifting device such as a wire driven by a winch mounted on the platform.

U.S. Pat. No. 4,829,928 describes an ocean platform that has a negatively buoyant pontoon suspended from the balance of the platform to increase the heave resonant period. Tendons suspend the pontoon to a depth where dynamic wave forces do not materially act directly on it in seas of normally occurring periods of up to about 15 seconds but do in seas of periods above about 15 seconds. Columns and an upper pontoon provide buoyancy for the platform.

U.S. Pat. No. 4,864,958 describes an anchored platform of the Ship Waterplane Area Protected (SWAP) type. This platform is of similar design to a SWAP-type free floating platform with the additional elements of a downward extension of a vertical hollow column, tensioned anchor chains, catenary mooring lines and anchors, a foundation including a pontoon, ballast, anchoring arrangements and a well template.

U.S. Pat. No. 5,707,178 describes a tension base for a tension leg platform. A buoyant base is submerged below the water surface and is retained with base tendons to a foundation on the sea floor. The buoyant base is attachable to the mooring tendons of a tension leg vessel positioned above the buoyant base. The buoyant base can be selectively ballasted to control the tension in the base tendons. Additional buoyant bases and connecting tendons can extend the depth of the total structure. Mooring lines can be connected between the buoyant base and the sea floor to limit lateral movement of the buoyant base. The buoyant base creates a submerged foundation which is said to reduce the required length of a conventional tension leg platform. The tension leg platform can be detached from the buoyant base and moved to another location.

U.S. Pat. No. 4,626,137 describes a submerged multi-purpose facility which employs anchored tethers and a balanced buoyant/ballast to keep the facility in location. Drift is controlled by tethering the facility to the sea bottom using one or more cables or other slightly flexible tie-down means.

U.S. Pat. No. 6,478,511 describes a floating system held in position on the sea bed by one or several vertical or nearly vertical tensioned lines made of a material that is not very sensitive to fatigue stresses and the tensioned line or lines are sized in a manner independent of the fatigue phenomena associated with the dynamic behavior of the floating system under the effect of external loadings.

U.S. Pat. No. 4,585,373 describes a pitch period reduction apparatus for tension leg platforms. A tension leg platform is provided with exterior buoyant columns located outside the normal tension leg platform structure. The exterior columns decrease the pitch period of the tension leg platform away from the point of concentration of the largest wave spectrum energy encountered at a particular marine location. Modification of the pitch period of the tension leg platform in this manner is said to reduce the cyclic fatigue stresses in the tension legs of the platform, and thereby increase the useful life of the platform structure.

U.S. Pat. No. 6,431,167 illustrates a variety of offshore platforms of the prior art and additionally describes a tendon-based floating structure having a buoyant hull with sufficient fixed ballast to place the center of gravity of the floating structure below the center of buoyancy of the hull. A support structure coupled to an upper end of the hull supports and elevates a superstructure above the water surface. A soft tendon is attached between the hull and the seafloor. A vertical stiffness of the soft tendon results in the floating structure having a heave natural period of at least twenty seconds.

U.S. Pat. No. 6,718,901 describes an "extendable draft platform" that has a buoyant equipment deck on a buoyant pontoon with elongated legs on the pontoon, each comprising a buoyant float, that extend movably through respective openings in the deck. Chains extending from winches on the deck are reeved through fairleads on the pontoon and connected back to the deck. The chains are tightened to secure the deck to the pontoon for conjoint movement to an offshore location. The chains are loosened and the pontoon and leg floats ballasted so that the pontoon and leg floats sink below the floating deck. The chains are then re-tightened until pawls on the leg floats engage the deck. The buoyancy of at least one of the pontoon and leg floats is increased so that the deck is thereby raised above the surface of the water. The chains are connected to mooring lines around an offshore well site, and the raised deck and submerged pontoon are maintained in a selected position over the site with the winches.

U.S. Patent Publication No. 2005/0084336 A1 describes a deck-to-column connection for an extendable draft platform, a type of deep-draft semi-submersible platform. The extendable draft platform has a deck and buoyancy columns installed in leg wells in the deck for vertical movement from a raised position to a submerged position. A connection arrangement secures the columns to the deck when the columns are in the submerged position. In the connection arrangement, a plurality of first guide elements near the top of each column is engageable by a plurality of complementary second guide elements secured to the deck around each leg well when the column is lowered to its submerged position. A locking mechanism is operable between the columns and the deck when the first guide elements are engaged with the second guide elements. The first and second guide elements may be configured so that the connection between the deck and the columns may be enhanced by over-ballasting the columns and/or by welding the columns to the deck.

BRIEF SUMMARY OF THE INVENTION

A TLP according to the present invention eliminates the subsea pontoons which extend between the surface-piercing columns of the TLPs of the prior art. Structural elements above the water surface provide the rigidity typically furnished by the pontoons of multi-column TLPs of the prior art. In certain embodiments, the buoyancy of the columns is increased by the addition of subsea sections of increased diameter (and/or cross-sectional area) to provide the buoyancy furnished by the pontoons of the TLPs of the prior art.

Certain embodiments of the invention feature a deck support structure comprising plate-type trusses or "box beams" which may assume a variety of configurations. Other embodiments of the invention have a deck support structure comprising open-type trusses. Gussets or similar above-water braces between the deck support structure and the surface-piercing columns act to further increase the rigidity and structural strength of the platform.

A pontoonless TLP according the invention has a smaller subsea projected area in both the horizontal and vertical planes than a conventional multi-column TLP of equivalent load-bearing capacity having pontoons between the columns. This reduction in surface area results in a reduction in the platform's response to ocean currents and wave action which consequently allows the use of smaller and more economical mooring systems. Additionally, the smaller vertical projected area results in a shorter natural period which enables a TLP according to the present invention to be deployed in greater water depths where conventional TLPs cannot be used due to their longer natural periods.

The elimination of pontoons from a multi-column TLP has the added benefit of providing an unobstructed path for risers to connect with the deck of the platform. In TLPs of conventional design, risers must typically be supported on subsea pontoons because supporting the riser from the deck would risk mechanical contact between the riser and pontoon below it. Installation and maintenance of the riser support and fluid connection to the riser are both facilitated by locating it on the deck rather than having it below the surface of the water.

BRIEF DESCRIPTION OF THE SEVERAL VIEWS OF THE DRAWING(S)

FIG. 3 is a perspective view of the deck support structure of a TLP according to a second embodiment of the invention.

FIG. 4 is a perspective view of one corner of the deck support structure of a TLP according to a third embodiment of the invention.

DETAILED DESCRIPTION OF THE INVENTION

Figure 1:
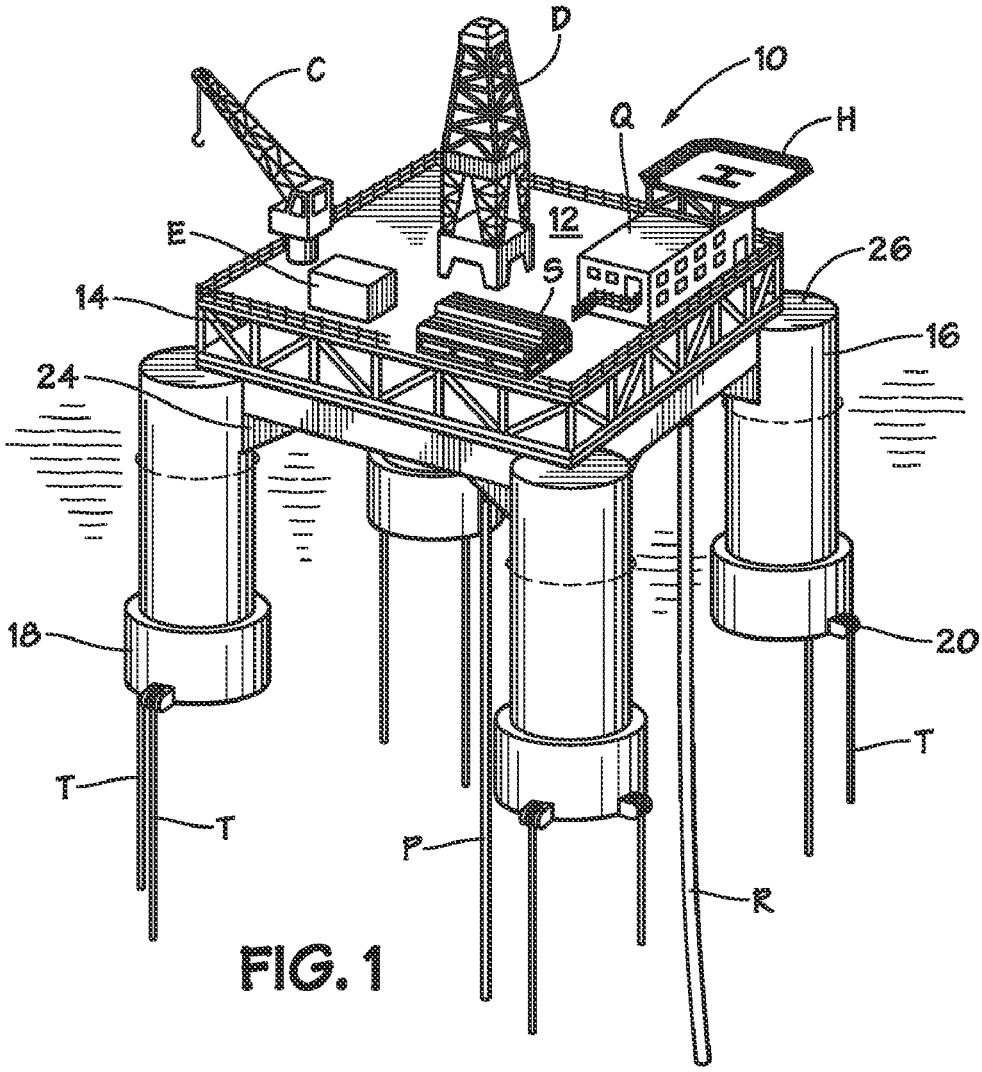
FIG. 1 is a perspective view of an installed pontoonless TLP according to one embodiment of the invention.

The invention may best be understood by reference to certain illustrative embodiments. FIG. 1 depicts a TLP 10 according to a first embodiment of the invention installed at an offshore location. As is conventional for tension leg platforms, the buoyant hull of the vessel (comprised of columns 16) is anchored to the seafloor by tendons T which are tensioned to hold the vessel such that the waterline in its installed condition is above that of its free-floating state. This arrangement eliminates most vertical movement of the structure.

TLP 10 comprises a deck 12 which may be configured to suit the particular needs of the owner or operator. A typical deck layout for a drilling operation is shown in FIG. 1 and includes derrick D, helicopter landing facility H, crew quarters Q, loading crane C, equipment E and supplies S. Catenary risers R and vertical risers P may be supported by the TLP from deck 12.

Framework 14 allows deck 12 to be a separate, detachable unit thereby facilitating both fabrication and installation. In certain applications, it has been found advantageous to set the deck on the deck support structure of the TLP using heavy-lift barge cranes subsequent to installation of the hull portion of the structure at the operations site.

Deck support 22 structurally interconnects columns 16. Deck 12 rests on deck support structure 22 and upper surface 26 of each column. It will be appreciated that although the illustrated embodiments have four columns and a generally square configuration, platforms having other form factors may benefit from the practice of the invention. For example, a three-column configuration may be used for applications requiring lower load-bearing capacity. Higher capacity structures may have more than four columns. The geometry of the deck need not be the same as that of the hull or of the deck support structure. By way of example, a triangular deck support structure may be used to support a generally rectangular deck.

To provide increased buoyancy without an increase in waterplane area, columns 16 may include a subsea portion 18 of larger diameter. Larger diameter sections 18 may be sized to provide approximately the buoyancy provided by the pontoons of the multi-column TLPs of the prior art. Tendon porches 20 may be located on larger diameter sections 18 of columns 16 for attachment of tendons T by conventional means. It should be appreciated that while the illustrated embodiments feature columns 16 of generally circular cross-section, the invention may be practiced with columns having other cross-sectional shapes. Likewise, "larger diameter sections" 18 should be understood to include non-circular shapes having a larger cross-sectional area than the above-water portion of the column 16.

Figure 2:
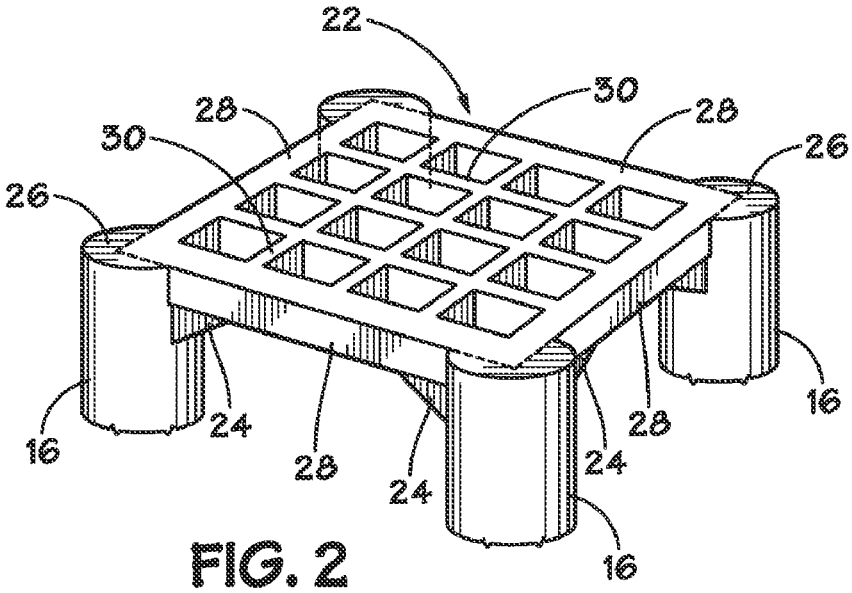
FIG. 2 is a perspective view of the deck support structure of a TLP according to a first embodiment of the invention.

The deck support structure may include structural steel components. A deck support structure 22 comprised of box girders is shown in FIG. 2. Although more expensive to fabricate and perhaps more difficult to maintain (because of the need for access to a confined space inside the box), box girders have a number of key advantages as compared to I-beam (or "wide flange") girders: better resistance to torsion; and, larger girders can be constructed, because the presence of two webs allows wider and hence stronger flanges to be used. This in turn allows longer spans.

Deck support structure 22 may comprise perimeter members 28 and generally orthogonal interior members 30. As shown in FIGS. 2 and 3, the perimeter members 28 may be larger in width, depth or both dimensions, than interior members 30.

Optional gussets 24 connecting perimeter members 28 and columns 16 may be used to increase the structure's resistance to bending loads at the column-to-deck support juncture. As will be appreciated by those skilled in the art, other bracing means may be used to accomplish this purpose.

The distance G between the nominal waterline of the platform in its installed condition and the underside of deck support structure 22 is known as the air gap. This distance G is typically selected to exceed the wave height of the platform's design storm so that the platform does not experience a possibly catastrophic uplift force which might occur if waves were allowed to strike deck support structure 22 or deck 12.

The embodiment illustrated in FIG. 3 has an alternative arrangement of interior box girders 30' which are configured to form central opening or "moon pool" 32 in deck support structure 22'. Opening 32 may accommodate vertical risers P which connect to equipment on deck 12. As in the embodiment illustrated in FIG. 2, optional gussets 24 connecting perimeter members 28 and columns 16 may be used to increase the structure's resistance to bending loads at the column-to-deck support juncture. Other bracing means known in the art may be used to accomplish this purpose.

FIG. 4 illustrates a third embodiment of the invention wherein deck support structure 22" is comprised of an open truss framework. Perimeter members 34 connect adjacent columns 16 and may support the perimeter of deck 12. Generally orthogonal interior trusses 36 connect opposing perimeter members 34 and provide interior support for deck 12. The trusses may be constructed from flanged members including Z-Shape (half a flange in opposite directions), HSS-Shape (hollow structural section also known as SHS (structural hollow section) and including square, rectangular, circular (pipe) and elliptical cross-sections), angle (L-shaped cross-section), channel (C-shaped cross-section), tee (T-shaped cross-section), or any other configuration having the requisite structural properties.

In the embodiment illustrated in FIG. 4, deck support structure 22" is comprised of parallel chord or "flat" trusses. Many flat truss designs are known in the art. Examples include the Pratt configuration, the Warren configuration and the Howe configuration. It will be appreciated by those skilled in the art that many flat and non-flat truss designs may be chosen for the deck support structure of a TLP according to the invention.

As in the embodiments illustrated in FIGS. 2 and 3, optional gussets 24 connecting perimeter members 34 and columns 16 may be used to increase the structure's resistance to bending loads at the column-to-deck support juncture. Other bracing means known in the art may be used to accomplish this purpose.

Although the invention has been described in detail with reference to certain preferred embodiments, variations and modifications exist within the scope and spirit of the invention as described and defined in the following claims.

What is claimed is:

1. A tension leg platform comprising:

a plurality of buoyant columns, each of said columns comprising a first section having a first cross-sectional area and a second section having a second cross-sectional area larger than the first cross-sectional area;

at least one, substantially vertical tendon per column, said tendon attached to the column at a first end and attached to an anchor in the seafloor at a second end such that when the platform is installed in its operating condition the tendons hold the platform below its free-floating draft;

a deck support structure connecting each buoyant column to at least two adjacent columns, the deck support structure attached to the buoyant columns such that the deck support structure is above the waterline of the tension leg platform when the tension leg platform is installed in its operating condition;

an unobstructed opening between each pair of adjacent columns which extends at least from the waterline of the tension leg platform when the tension leg platform is installed in its operating condition to the base of each column of the pair of adjacent columns.

2. A tension leg platform as recited in claim 1 wherein the second section of the buoyant columns is at a greater depth than the first section when the tension leg platform is installed in its operating condition.

3. A tension leg platform as recited in claim 1 wherein the deck support structure is above the wave height of the design storm of the tension leg platform.

4. A tension leg platform as recited in claim 1 wherein the air gap of the platform exceeds the wave height of the design storm of the platform.

5. A tension leg platform as recited in claim 1 wherein the deck support structure comprises box girders.

6. A tension leg platform as recited in claim 1 wherein the deck support structure comprises trusses.

7. A tension leg platform as recited in claim 6 wherein the trusses comprise parallel chord trusses.

8. A tension leg platform as recited in claim 1 further comprising gusset plates between the buoyant columns and the deck support structure.

9. A tension leg platform as recited in claim 1 further comprising diagonal braces between the buoyant columns and the deck support structure.

10. A tension leg platform comprising:

a plurality of generally vertical, buoyant columns, each of said columns comprising a first section having a first cross-sectional area and a second section having a second cross-sectional area larger than the first cross-sectional area;

at least one, substantially vertical tendon per column, said tendon having a first end attached to the column and a second end attached to an anchor in the seafloor such that when the platform is installed in its operating condition the tendons hold the platform below its free-floating draft;

an above-water deck support structure interconnecting the buoyant columns;

the tension leg platform having no subsea structural members extending between the buoyant columns.

11. A tension leg platform as recited in claim 10 wherein the second section of the buoyant columns is at a greater depth than the first section when the tension leg platform is installed in its operating condition.

12. A tension leg platform as recited in claim 10 wherein the deck support structure is above the wave height of the design storm of the tension leg platform.

13. A tension leg platform as recited in claim 10 wherein the air gap of the platform exceeds the wave height of the design storm of the platform.

14. A tension leg platform as recited in claim 10 wherein the deck support structure comprises box girders.

15. A tension leg platform as recited in claim 10 wherein the deck support structure comprises trusses.

16. A tension leg platform as recited in claim 15 wherein the trusses comprise parallel chord trusses.

17. A tension leg platform as recited in claim 10 further comprising gusset plates between the buoyant columns and the deck support structure.

18. A tension leg platform as recited in claim 10 further comprising diagonal braces between the buoyant columns and the deck support structure.

* * * * *